US007771840B2

(12) United States Patent
Ueda et al.

(10) Patent No.: US 7,771,840 B2
(45) Date of Patent: Aug. 10, 2010

(54) ALUMINUM ALLOY PLATE AND HEAT EXCHANGER FORMED THEREOF

(75) Inventors: Toshiki Ueda, Tochigi (JP); Akihiro Tsuruno, Tochigi (JP); Fumihiro Koshigoe, Tochigi (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 293 days.

(21) Appl. No.: 11/909,168

(22) PCT Filed: Mar. 27, 2006

(86) PCT No.: PCT/JP2006/306080

§ 371 (c)(1),
(2), (4) Date: Sep. 20, 2007

(87) PCT Pub. No.: WO2006/101226

PCT Pub. Date: Sep. 28, 2006

(65) Prior Publication Data

US 2009/0078398 A1 Mar. 26, 2009

(30) Foreign Application Priority Data

Mar. 25, 2005 (JP) ..... 2005-089210

(51) Int. Cl.
*B32B 15/20* (2006.01)
*B32B 15/01* (2006.01)
*B23K 1/19* (2006.01)

(52) U.S. Cl. ..... 428/654; 228/262.5; 228/262.51

(58) Field of Classification Search ..... None
See application file for complete search history.

(56) References Cited

U.S. PATENT DOCUMENTS 6,465,113 B2 * 10/2002 Yamada et al. ..... 428/654
7,514,155 B2 * 4/2009 Benedictus et al. ..... 428/654
2002/0037426 A1 * 3/2002 Yamada et al. ..... 428/654

FOREIGN PATENT DOCUMENTS

JP 2002 294377 10/2002

(Continued)

OTHER PUBLICATIONS

Ozaki et al ( JP2005-232507 English Machine Tranlation) Sep. 2005.*
Ozaki et al ( JP2004-035966) English Machine Tranlation) Feb. 2004.*

(Continued)

*Primary Examiner*—Jennifer C. McNeil
*Assistant Examiner*—Jason L Savage
(74) *Attorney, Agent, or Firm*—Oblon, Spivak, McClelland, Maier & Neustadt, L.L.P.

(57) ABSTRACT

There are provided an aluminum alloy plate having high strength and excellent corrosion resistance even though the plate is made thinner, and a heat exchanger formed thereof. In an aluminum alloy plate having a core material and a surface material cladded on at least one side of the core material, the surface material includes 0.030-0.30% by mass of Fe, 0.40-1.9% by mass of Mn, 0.40-1.4% by mass of Si, and 2.0-5.5% by mass of Zn, the rest comprises Al and inevitably included impurities, and an area ratio of an intermetallic compound containing Al and Mn to a whole surface of the surface material is 1% or less.

14 Claims, 2 Drawing Sheets

FOREIGN PATENT DOCUMENTS

| | | | |
|---|---|---|---|
| JP | 2004 35966 | | 2/2004 |
| JP | 2005 232507 | | 9/2005 |
| JP | 2006-015376 | * | 1/2006 |
| JP | 2006-015377 | * | 1/2006 |

OTHER PUBLICATIONS

U.S. Appl. No. 12/335,950, filed Dec. 16, 2008, Koshigoe, et al.
U.S. Appl. No. 12/519,023, filed Jun. 12, 2009, Ueda, et al.
U.S. Appl. No. 12/528,807, filed Aug. 27, 2009, Koshigoe, et al.

* cited by examiner (a)

(b)

ALUMINUM ALLOY PLATE AND HEAT EXCHANGER FORMED THEREOF

TECHNICAL FIELD

The present invention relates to an aluminum alloy plate having excellent corrosion resistance, and a heat exchanger formed thereof.

BACKGROUND ART

Conventionally, as a material for an aluminum heat exchanger, there has been used various aluminum materials having a brazing material and a sacrificial material (hereinafter, frequently referred to as "surface material") on one side or both sides of the aluminum material. Especially, as a material for a heat exchanger for an automobile, it is demanded that the aluminum material be made thinner while high strength and high corrosion resistance are maintained. In order to meet such demands, for example, JP-A-2002-294377 discloses an aluminum alloy composite material for brazing having high strength and high corrosion resistance, which is made notably thin while high brazing property is retained.

In the aluminum alloy composite material for brazing disclosed in the above-mentioned patent document, an aluminum alloy plate includes a core material and a Zn, Mn, Si-containing surface material cladded on one side of the core material, while a composition of the core material, a composition of the surface material and a thickness thereof are adjusted.

Specifically, in the patent document above, the core material composition includes 0.2% by mass or less of Mg, 0.3% by mass or less of Cr, 0.2% by mass or less of Fe, 0.2-1.0% by mass of Cu, 0.3-1.3% by mass of Si (with a total amount of Cu and Si being 2.0% by mass or less), 1.5% by mass or less of Mn, 0.02-0.3% by mass of Ti. The rest includes Al and inevitably included impurities.

The surface material composition includes at least one member selected from 2-5% by mass of Zn, 0.3-1.2% by mass of Mn, and 0.04-0.9% by mass of Si, and the rest includes Al and inevitably included impurities. The clad ratio of the surface material is set at 15% or more of the total thickness. In this manner, the aluminum alloy composite material is optimized.

However, more corrosion resistance is demanded for the surface material, in order to enhance the endurance of the heat exchanger. When the aluminum alloy composite material with the Mn, Si-containing surface material, such as those described in the above document, is brought into contact with water, a water-containing coolant or the like, a cathode reactivity increases at an interface therebetween, leading to a problem of increased cathode reaction current upon corrosion progress, i.e., increased corrosion current. Therefore, once a local corrosion, such as pitting corrosion, occurs on the surface material, a corrosion rate is locally accelerated. Therefore, the optimization of the composition of Zn, Mn, Si of the surface material and the optimization of the clad ratio of the surface material may not provide sufficient corrosion resistance.

The present invention is completed with a view toward solving the above-mentioned problems. It is desirable to provide an aluminum alloy plate having high strength and excellent corrosion resistance even though the plate is made thinner, and a heat exchanger having excellent corrosion resistance formed of this aluminum alloy plate.

DISCLOSURE OF THE INVENTION

In order to solve the above-mentioned problems, the present inventors focused on configurations of intermetallic compounds in the surface material of the aluminum alloy plate, and made various studies regarding effects on the cathode reaction under corrosive environment, by the surface material composition and the configuration of the intermetallic compound of elements composing the surface material. As a result, they found that by adjusting the configuration of the Al—Mn-containing intermetallic compound on the surface of the aluminum alloy, as well as the aluminum composition, the aluminum alloy plate having both high strength and excellent corrosion resistance can be obtained, and thus completed the invention.

Therefore, in one aspect of the present invention, there is provided the following aluminum alloy plate.

[1] An aluminum alloy plate having a core material and a surface material cladded on at least one side of the core material, wherein the surface material includes 0.030-0.30% by mass of Fe, 0.40-1.9% by mass of Mn, 0.40-1.4% by mass of Si, and 2.0-5.5% by mass of Zn, the rest includes Al and inevitably included impurities, and an area ratio of an intermetallic compound containing Al and Mn to a whole surface of the surface material is 1% or less.

[2] The aluminum alloy plate according to [1], when the surface material is cladded only on one side of the core material, further including a brazing material of an Al—Si based alloy cladded on the other side of the core material.

[3] The aluminum alloy plate according to [1] or [2], wherein the surface material further includes 0.30-3.0% by mass of Mg.

[4] A heat exchanger formed of the aluminum alloy plate according to [3].

The various aspects, other effects and further features of the present invention will become more apparent by describing in detail illustrative, non-limiting embodiments thereof with reference to the accompanying drawings.

BEST MODE FOR CARRYING OUT THE INVENTION

Figure 1:
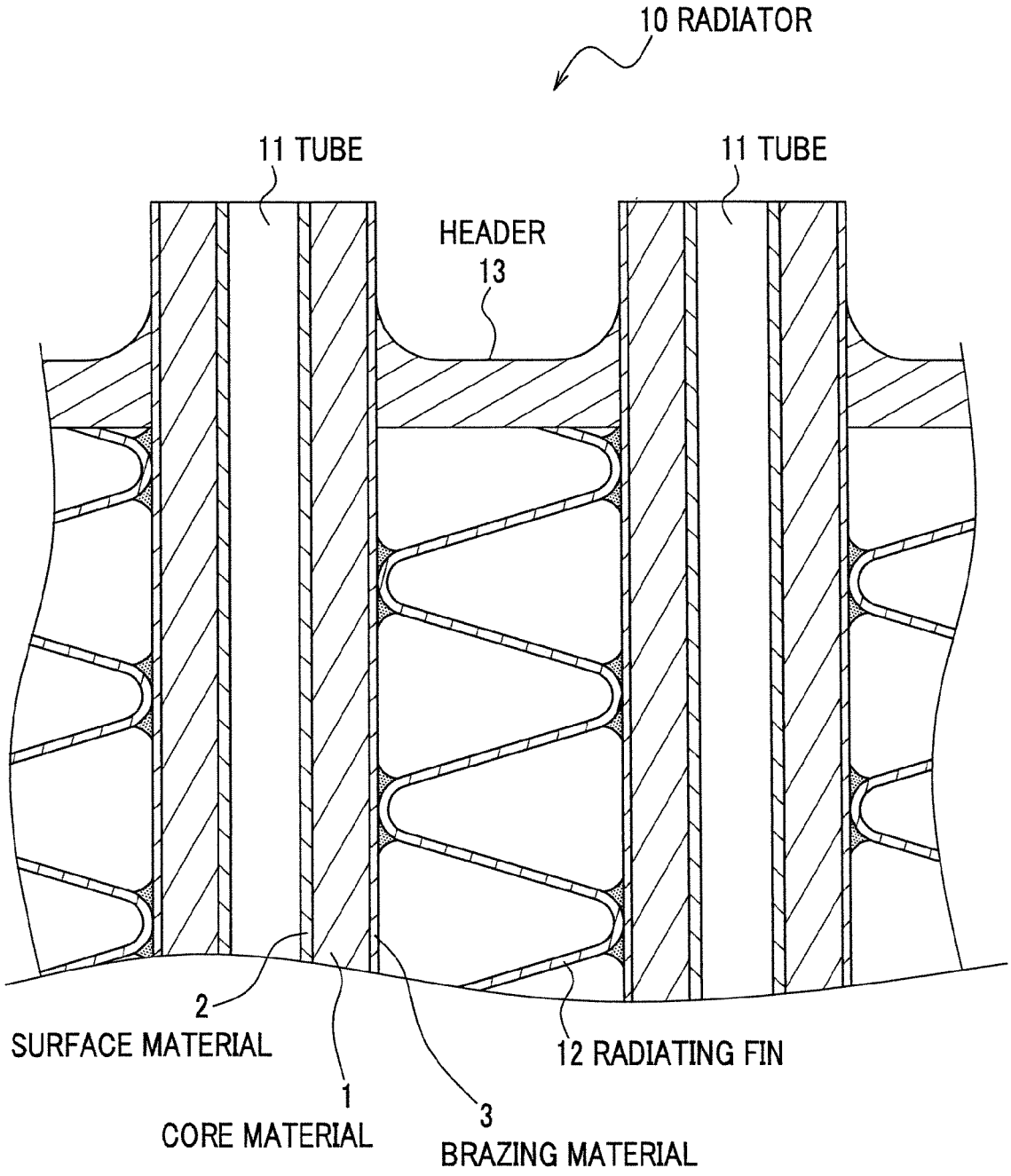
FIG. 1 is a cross sectional view showing a part of a tube of a heat exchanger according to one embodiment.

Embodiments of the present invention will be described in detail below. It should be noted that the present invention is not limited to the embodiments described here, and it is a matter of course that these embodiments may be properly modified within a scope of the technical idea of the present invention.

<Aluminum Alloy Plate>

It was found that an aluminum alloy plate having high strength and excellent corrosion resistance can be obtained even though the plate is made thinner, when the surface material composition of the aluminum alloy plate includes 0.030-0.30% by mass of Fe, 0.40-1.9% by mass of Mn, 0.40-1.4% by mass of Si, and 2.0-5.5% by mass Zn, the rest includes Al and inevitably included impurities, and the area ratio of the intermetallic compound containing Al and Mn to a whole surface of the surface material is 1% or less.

Hereinafter, "intermetallic compound containing Al and Mn" is frequently referred to as "Al—Mn based intermetallic compound". In the following descriptions, "area ratio of the intermetallic compound containing Al and Mn to the whole surface of the surface material" may be frequently and simply referred to as "area ratio".

Hereinbelow, the reasons for setting the amounts of the various components as above and for setting the area ratio as above will be explained, with respect to the aluminum alloy plate having high strength and excellent corrosion resistance.

(Surface Material—Fe: 0.030-0.30% by Mass)

In the aluminum alloy plate, Fe forms a solid solution and finely dispersed particles of Al—Fe based intermetallic compound with a diameter of 1 μm or less, and contributes to strength enhancement.

When the amount of Fe is 0.030% by mass or less, an effect of strength enhancement by solid solution formation is not satisfactory. On the other hand, when the amount of Fe is 0.30% by mass or more, the amount of Al—Fe based intermetallic compound, such as Al—(Fe,Mn) based, Al—Fe—Si based and Al—(Fe,Mn)—Si based intermetallic compounds increases, which in turn increases cathode reaction, leading to lower corrosion resistance of the surface material. Therefore in the embodiment of the present invention, the amount of Fe is set at 0.030-0.30% by mass.

(Surface Material—Mn: 0.40-1.9% by Mass)

In the aluminum alloy plate, Mn forms a solid solution and finely dispersed particles of Al—Mn based intermetallic compound with a diameter of 1 μm or less, and contributes to strength enhancement. When the amount of Mn is 0.40% by mass or less, an effect of strength enhancement by solid solution formation is not satisfactory. On the other hand, when the amount of Mn is 1.9% by mass or more, the amount of Al—Mn based intermetallic compound, such as Al—(Mn, Fe) based, Al—Mn—Si based, Al—(Mn,Fe)—Si based intermetallic compounds increases, which in turn increases cathode reaction, leading to lower corrosion resistance of the surface material. Therefore in the embodiment of the present invention, the amount of Mn is set at 0.40-1.9% by mass.

(Surface Material—Si: 0.40-1.4% by Mass)

In the aluminum alloy plate, Si forms a solid solution and contributes to strength enhancement. When the amount of Si is 0.40% by mass or less, an effect of strength enhancement by solid solution formation is not satisfactory. On the other hand, when the amount of Si is 1.4% by mass or more, the amounts of Al—Mn—Si based, Al—Fe—Si based intermetallic compounds increase, which in turn increases cathode reaction, leading to lower corrosion resistance of the surface material. Therefore in the present embodiment, the amount of Si is set at 0.40-1.4% by mass.

(Surface Material—Zn: 2.0-5.5% by Mass)

The reason for adding Zn to the surface material in the present embodiment is to obtain an effect of a sacrificial anode, by making the surface material electrochemical-potentially lower than the core material.

In order to obtain an aluminum alloy plate having high strength and excellent corrosion resistance, not only an alloy composition of the surface material, but also that of the core material should be adjusted. Accordingly, in general, Cu is added to the core material. Cu is an element that enhances strength of the core material, and by adding 0.20% by mass or more of Cu, strength of the core material can be enhanced. Though Cu can enhance strength of the core material, Cu also increases susceptibility to intergranular attack, which reduces corrosion resistance on the surface material side.

Therefore, when the amount of Cu in the core material, which is used in combination with the surface material of the present embodiment, exceeds 0.2% by mass, 2% by mass or more of Zn is added to the surface material, so as to give a sacrificial anode effect to the surface material to compensate the susceptibility to intergranular attack in the core material. Consequently, the surface material can be made potentially lower than the grain boundary, and at the same time, intergranular attack can be prevented, resulting in prevention of lowering of corrosion resistance on the surface material side.

On the other hand, when the amount of Zn is 5.5% by mass or more, the melting point of the surface material becomes lower and castability becomes poor, leading to low productivity upon ingot casting. Therefore in the present embodiment, the amount of Zn is set at 2.0-5.5% by mass.

(Area Ratio of Al—Mn Based Intermetallic Compound to Whole Surface of Surface Material: 1% or Less)

When the surface material is left in corrosive environment, it is often the case that a reductive reaction of oxygen is predominant in a cathode reaction. The present inventors made intensive and extensive studies, and as a result, they found that the cathode reactivity is remarkably affected by not only aluminum in a solid solution state, but also the configuration of the Al—Mn based intermetallic compound present in the surface.

Accordingly, when the area ratio of the Al—Mn based intermetallic compound to the whole surface of the surface material is 1% or less, a cathode reactivity on the surface material does not increase even under corrosive environment and the corrosion current density is reduced, resulting in enhanced corrosion resistance of the surface material.

A smaller area ratio of the Al—Mn based intermetallic compound gives a lower cathode reactivity on the surface material, and there is no limitation for the lower limit of the area ratio. It should be noted that the area ratio is always larger than 0%, since the Al—Mn based intermetallic compound is inevitably formed as long as the aluminum alloy plate is one with the composition of the present embodiment.

It is important that the area ratio of the Al—Mn based intermetallic compound to the whole surface of the surface material is made 1% or less, especially from a viewpoint of reducing cathode reactivity at an initial stage of corrosion.

The aluminum alloy plate with the area ratio of 1% or less can be obtained by adjusting the amount of Mn+Fe in the composition to less than 0.6% by mass; whereas, when Mn+Fe in the aluminum alloy plate composition is equal to or larger than 0.6% by mass, the aluminum alloy plate with the area ratio of 1% or less can be obtained by cooling at a rate of 1° C./min or more during casting process, and adjusting the mass ratio of the amount of Fe to the amount of Mn contained in the surface material (Fe/Mn) to less than 0.4.

When the mass ratio Fe/Mn is less than 0.4, crystallization of the Al—Mn based intermetallic compound does not notably develop during casting process, and the area ratio becomes 1% or less. When Fe/Mn is equal to or larger than 0.4, the area ratio exceeds 1%. The reason is believed that, as the ratio Fe/Mn increases, crystallization of the Al—Mn based intermetallic compound is facilitated.

When the cooling rate upon casting is less than 1° C./min, growth of the Al—Mn based intermetallic compound is facilitated. Therefore, it is preferred that the cooling rate be 1° C./min or more.

(Surface Material—Mg: 0.3-3.0% by Mass)

Mg contributes to strength enhancement of the aluminum alloy plate, but degrades brazing property.

In the case of the aluminum alloy plate in which the surface material is on one side of the core material and the brazing material is on the other side, if the above-mentioned core material is thin, Mg added for strength enhancement of the surface material may diffuse in the core material by heat during brazing, and reach the brazing material on the opposite side, leading to deterioration of brazing property.

On the other hand, by making the core material sufficiently thicker to reduce the amount of Mg that diffuses in the core material and reaches the brazing material, strength of the surface material can be enhanced without spoiling the brazing property. Specifically, the core material can be 2.5 times as thick as the brazing material, with the thickness ranging from 0.1 to 1.0 mm.

In this case, when the amount of Mg in the surface material is less than 0.30% by mass, the strength enhancement effect of the surface material is not satisfactory. When the amount exceeds 3.0% by mass, pressure bonding property is lowered during hot-rough rolling in cladding process in which the surface material and the core material are joined. As a result, the surface material is easily delaminated from the core material, leading to low yield and thus low productivity. Therefore in the present embodiment, the amount of Mg is set at 0.3-3.0% by mass.

(Inevitably Included Impurities)

The aluminum alloy plate of the present invention is allowed to include inevitably included impurities, as long as they do not interfere with the effect of the present invention. Examples of such inevitably included impurities include 0.1% by mass or less of Cr, 0.2% by mass or less of Ti, 0.2% by mass or less of Zr and 0.1% by mass or less of B.

(Brazing Material)

For the brazing material, any known brazing material can be appropriately used. For example, a brazing material made of an aluminum alloy containing 7-12% by mass of Si (Al—Si based alloy) can be applied to the aluminum alloy plate of the present embodiment, which can be then used to make a heat exchanger and the like.

(Core Material)

If desired, the core material made of aluminum alloy to be used together with the surface material of the present embodiment can be appropriately selected from, for example, a core material including 0.5-1.2% by mass of Cu, 0.6-1.9% by mass of Mn and 0.5-1.4% by mass of Si, with the rest including Al and inevitably included impurities; and a core material including 0.5-1.2% by mass of Cu, 0.6-1.9% by mass of Mn, 0.5-1.4% by mass of Si, and at least one of 0.05-0.3% by mass of Cr and 0.05-0.3% by mass of Ti, with the rest including Al and inevitably included impurities.

<Heat Exchanger>

Next, a heat exchanger formed of the aluminum alloy plate according to the present embodiment will be described by illustrating the case where the heat exchanger is used as a tube of a radiator. FIG. 1 is a cross sectional view showing a part of a tube 11 of a radiator 10 formed of the aluminum alloy plate according to the present embodiment.

In the radiator 10 according to the present embodiment, the tubes 11, radiating fins 12, and headers 13 connecting the tubes 11 are assembled by brazing. The tube 11 is made of the aluminum alloy plate with the surface material 2 on the inner side of the core material 1 and the brazing material 3 on the outer side of the core material 1. The tube is configured in such a manner that the surface material 2 serves as an inner periphery of the tube 11, i.e., a side that comes into contact with cooling water, and the brazing material 3 serves as an outer periphery.

The tube 11 is obtained by, for example, forming a cylindrical tube by a fin pass roller from an aluminum alloy plate fed from an uncoiler; joining ends of the aluminum alloy plate by electro-resistance-welding using a high-frequency induction welding machine and the like; removing unnecessary bead portions by a bead cutter; and reshaping the tube to have a specific size and specific shape by a sizing roller.

The tube 11 may be brazed to the radiating fin 12 and the header 13 in the following manner, for example. First, on the tubes 11, the radiating fins 12 and the headers 13 arranged as shown in FIG. 1, Nocolok flux is sprayed and dried. The resultant article was heated for 5 minutes in a nitrogen atmosphere at 600° C., with a dew point of −40° C. and an oxygen content of 300 ppm, to thereby form a fillet at contacting portions among the tubes 11, the radiating fins 12 and the headers 13, and thus complete brazing.

With the use of the aluminum alloy plate having high strength and high corrosion resistance according to the present invention, a heat exchanger having excellent corrosion resistance can be provided. Especially, the aluminum alloy plate can be suitably used as a material for an automobile heat exchanger or the like which is obtained by brazing. The resultant heat exchanger, when used as a radiator tube, a heater core tube or a header plate material, gives excellent corrosion resistance to an inner surface (coolant side), or when used as an evaporator or condenser, gives excellent corrosion resistance to an outer surface (atmosphere side). Moreover, since the aluminum alloy plate according to the present invention has high strength, the heat exchanger can be made thinner, leading to a heat exchanger with a reduced weight.

EXAMPLES

Hereinbelow, the aluminum alloy plate according to the present embodiment will be more specifically described by referring to Tables 1 and 2, by comparing Examples that satisfies the requirements defined by the present invention and Comparative Example that does not satisfy the requirements.

Figure 2:
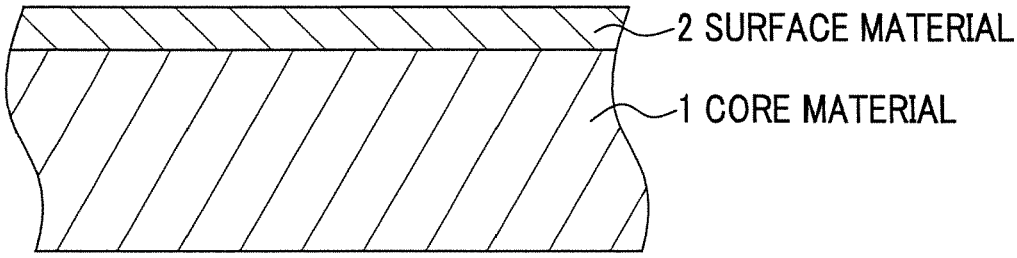
FIG. 2(*a*) is a cross sectional view showing a structure of a two-layered aluminum alloy plate, and FIG. 2(*b*) is a cross sectional view showing a structure of a three-layered aluminum alloy plate.
Figure 2:
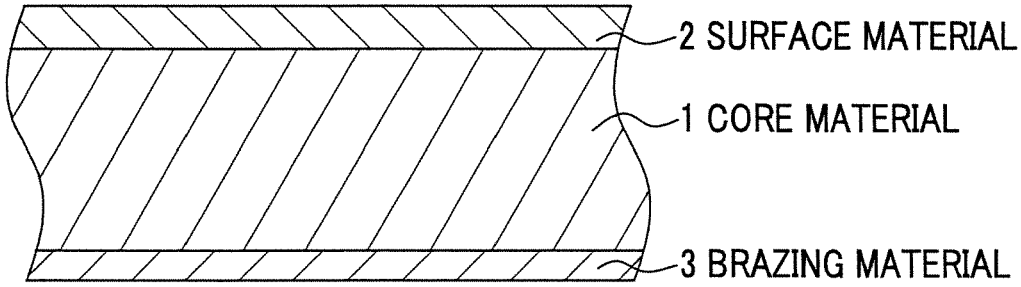

Using combinations of the surface material composition and the brazing material composition shown in Table 1, specimens of aluminum alloy plate with a thickness of 0.17-0.3 mm having either of 2-layered structure shown in FIG. 2(*a*) or 3-layered structure shown in FIG. 2(*b*) were obtained, by treatments of casting, homogenizing, hot rough rolling and cladding in a conventional manner, with appropriate heating or cool-stretching.

With respect to the aluminum alloy plate with the 2-layered structure, as shown in FIG. 2(*a*), the surface material 2 is cladded only on one side of the core material 1; with respect to the aluminum alloy plate with the 3-layered structure, as shown in FIG. 2(*b*), the surface material 2 is cladded on one side of the core material 1 and the brazing material 3 is cladded on the other side of the surface material 2.

With respect to the specimens, the surface materials S1-S6 shown in Table 1 satisfy the requirements according to the present invention, and were employed as the specimens for Examples 1-6, as shown in Table 2. On the other hand, the surface materials S7-S15 shown in Table 1 do not satisfy the requirements according to the present invention, and were employed as the specimens for Comparative Examples 7-15.

As shown in Table 1, the cooling rate of the surface material S9 upon casting was less than 1° C./min, and the cooling rate of the other surface materials was 1° C./min or more.

For the core material, an aluminum alloy including 0.80% by mass of Si, 0.18% by mass of Fe, 0.95% by mass of Cu, 1.4% by mass of Mn, 0.04% by mass of Mg, and 0.12% by mass of Ti was used.

In Table 1, an underline indicates that the value does not meet the requirement according to the present invention.

TABLE 1

| | Si (% by mass) | Fe (% by mass) | Cu (% by mass) | Mn (% by mass) | Mg (% by mass) | Zn (% by mass) | Fe + Mn (% by mass) | Fe/Mn | Cooling rate (° C./min) | Area ratio of intermetallic Compound (%) | Note |
|---|---|---|---|---|---|---|---|---|---|---|---|
| Brazing material No. | | | | | | | | | | | |
| F1 | 10 | 0.15 | 0.01 | 0.01 | 0.01 | — | | | | | |
| Surface material No. | | | | | | | | | | | |
| S1 | 0.54 | 0.15 | — | 0.78 | — | 4.5 | 0.93 | 0.19 | 1° C./min≦ | 0.72 | |
| S2 | 0.83 | 0.22 | — | 0.82 | — | 4.2 | 1.04 | 0.27 | 1° C./min≦ | 0.92 | |
| S3 | 0.85 | 0.10 | — | 1.20 | — | 4.8 | 1.30 | 0.08 | 1° C./min≦ | 0.95 | |
| S4 | 0.85 | 0.12 | — | 0.95 | — | 4.4 | 1.07 | 0.13 | 1° C./min≦ | 0.76 | |
| S5 | 0.66 | 0.05 | — | 0.78 | — | 3.5 | 0.83 | 0.06 | 1° C./min≦ | 0.68 | |
| S6 | 0.55 | 0.24 | — | 0.71 | 2.2 | 4.4 | 0.95 | 0.34 | 1° C./min≦ | 0.91 | Mg |
| S7 | 0.77 | 0.01 | — | 1.22 | — | 4.0 | 1.23 | 0.008 | 1° C./min≦ | 0.62 | Fe is below lower limit |
| S8 | 0.75 | 0.34 | — | 1.11 | — | 3.9 | 1.44 | 0.31 | 1° C./min≦ | 1.25 | Fe is above upper limit |
| S9 | 0.86 | 0.12 | — | 0.35 | — | 4.7 | 0.46 | 0.34 | 1° C./min> | 0.69 | Mn is below lower limit |
| S10 | 0.93 | 0.07 | — | 1.98 | — | 4.8 | 2.05 | 0.04 | 1° C./min≦ | 1.33 | Mn is above upper limit |
| S11 | 0.35 | 0.13 | — | 0.88 | — | 4.2 | 1.01 | 0.15 | 1° C./min≦ | 0.77 | Si is below lower limit |
| S12 | 1.48 | 0.07 | — | 0.77 | — | 4.1 | 0.84 | 0.09 | 1° C./min≦ | 1.36 | Si is above upper limit |
| S13 | 0.81 | 0.09 | — | 1.13 | — | 1.8 | 1.22 | 0.08 | 1° C./min≦ | 0.83 | Zn is below lower limit |
| S14 | 0.45 | 0.10 | — | 0.99 | 0.15 | 3.7 | 1.09 | 0.10 | 1° C./min≦ | 0.79 | Mg is below lower limit |
| S15 | 0.77 | 0.28 | — | 0.61 | — | 3.9 | 0.89 | 0.45 | 1° C./min≦ | 1.24 | Fe/Mn > 0.4 |

These specimens were heated under heating conditions of 600° C. for 5 minutes which correspond to brazing conditions, and then a measurement was made regarding <area ratio of intermetallic compound occupying surface of surface material>; and measurements and evaluations were made regarding <cathode reactivity on surface material side>, <corrosion resistance on surface material side> and <strength after brazing>.

<Area Ratio>

The area ratio of the Al—Mn based intermetallic compound to the whole surface of the surface material was measured in the following manner.

(1) For each of Examples and Comparative Examples, the surface of the specimen was polished until patterns on the surface appeared by rolling is vanished and buffed, to obtain a mirror finished surface.

(2) For each of Examples and Comparative Examples, the surface of the specimen after polishing was observed with a scanning electron microscope (JSM-T330, manufactured by JEOL Ltd.) at a magnification of ×500.

(3) Metallographic picture were taken under image processing of 30 fields of view and were analyzed (by a high speed image processor TOSPIX-II, manufactured by Toshiba Corporation). For each field of view in a range of 1 μm-15 μm, the area ratio of the Al—Mn based intermetallic compound was calculated. In the image analysis, the Al—Mn based intermetallic compound having a larger atomic weight than that of Al is distinguished as a whiter contrast.

<Cathode Reactivity on Surface Material>

The cathode reactivity on the surface material was evaluated by obtaining a cathode polarization curve using a three-electrode single-chamber type cell. In the three-electrode single-chamber type cell, platinum was used as a counter electrode, and an Ag/AgCl electrode in a saturated KCl solution was used as a reference electrode. Hereinafter, an electrode potential is described with taking this electrode as a reference.

In 5% by mass of an aqueous solution of NaCl which has been saturated with air by blowing air, the counter electrode, the reference electrode and the specimen were immersed, to thereby form a cell. The cathode polarization curve was obtained at room temperature at a potential sweep rate of 20 mV/min.

The cathode reactivity is evaluated in terms of the cathode current density under an electrode potential of −1.000V, at which a reduction reaction of oxygen is supposed to take place. Under this electrode potential, when the cathode current density is equal to or less than $1\times10^{-4}$ A/cm$^2$, the result is indicated with "G" which means "good", and when the cathode current density is larger than $1\times10^{-4}$ A/cm$^2$, the result is indicated with "P" which means "poor".

<Corrosion Resistance Evaluation of Surface Material>

Evaluation of the corrosion resistance of the surface material is made on the assumption that the aluminum alloy plate according to the present invention is used for the heat exchanger and the like and corrosion of the surface material proceeds both on an air side (outer face of the heat exchanger) and on a cooling-water side (inner face of the heat exchanger).

(Air Side Assumption Test: Corrosion Resistance in CASS Test)

On the assumption that corrosion proceeds on the air side, the specimens were tested based on CASS test for a continuous 250 hours in accordance with JISH8681, and evaluated in terms of corrosion depth after the test.

When the corrosion depth is the thickness of the surface material or less, the result is indicated with "E" which means "excellent"; when the corrosion depth is the thickness of the surface material plus less than 20 μm, the result is indicated with "G" which means "good"; and when the corrosion depth is the thickness of the surface material plus 20 μm or more, the result is indicated with "P" which means "poor".

(Cooling-Water Side Assumption Test: Corrosion Resistance in Immersion Test)

On the assumption that corrosion proceeds on the cooling-water side, the specimens were immersed in an aqueous solution for a corrosion simulation test ($Cl^-$: 300 ppm by mass, $SO_4^{2+}$: 100 ppm by mass, $Cu^{2+}$: 5 ppm by mass) at 88° C. for 8 hours. After that period of time, while the specimen was immersed in the solution, heating was terminated and the specimen was allowed to cool to room temperature, and to stand still for 16 hours. This cycle of corrosion test was repeated for 30 days, and the specimens were evaluated in terms of the corrosion depth after the test.

When the corrosion depth is the thickness of the surface material or less, the result is indicated with "E" which means "excellent"; when the corrosion depth is the thickness of the surface material plus less than 20 μm, the result is indicated with "G" which means "good"; and when the corrosion depth is the thickness of the surface material plus 20 μm or more, the result is indicated with "P" which means "poor".

<Strength after Brazing>

A JIS5 test piece was shaped from each specimen, and its tensile strength was measured at room temperature. With respect to the surface materials S6, S14 in which Mg was added to the surface material, the materials were brazed and allowed to stand at room temperature for 7 days, and then tensile strength was measured.

When the tensile strength is 180 MPa or more, the result is indicated with "E" which means "excellent"; when the tensile strength is 160 MPa or more, the result is indicated with "G" which means "good"; and when the tensile strength is less than 160 MPa, the result is indicated with "P" which means "poor".

Various characteristic values obtained as such are shown in Table 2.

TABLE 2

| | No. | Brazing material No. | Surface material No. | Plate thickness (mm)/surface material thickness (μm) | Surface material Fe/Mn | Area ratio of intermetallic compound (%) | Cathode reactivity | Corrosion resistance in immersion test | Corrosion resistance in CASS test | Strength after brazing | Note |
|---|---|---|---|---|---|---|---|---|---|---|---|
| Example | 1 | — | S1 | 0.17/35 | 0.19 | 0.72 | G | G | G | G | |
| | 2 | — | S2 | 0.20/40 | 0.27 | 0.92 | G | G | G | G | |
| | 3 | F1 | S3 | 0.20/40 | 0.08 | 0.95 | G | G | G | G | |
| | 4 | F1 | S4 | 0.25/45 | 0.13 | 0.76 | G | G | G | G | |
| | 5 | F1 | S5 | 0.30/50 | 0.06 | 0.68 | G | G | G | G | |
| | 6 | — | S6 | 0.17/35 | 0.34 | 0.91 | G | G | G | E | |
| Comparative Example | 7 | — | S7 | 0.17/35 | 0.008 | 0.62 | G | G | G | P | Fe is below lower limit |
| | 8 | F1 | S8 | 0.20/40 | 0.31 | 1.25 | P | P | P | G | Fe is above upper limit |
| | 9 | F1 | S9 | 0.25/45 | 0.34 | 0.69 | G | E | G | P | Mn is below lower limit |
| | 10 | — | S10 | 0.17/35 | 0.04 | 1.33 | P | P | P | G | Mn is above upper limit |
| | 11 | F1 | S11 | 0.20/40 | 0.15 | 0.77 | G | G | G | P | Si is below lower limit |
| | 12 | F1 | S12 | 0.25/45 | 0.09 | 1.36 | P | P | P | G | Si is above upper limit |
| | 13 | F1 | S13 | 0.30/50 | 0.08 | 0.83 | G | P | P | G | Zn is below lower limit |
| | 14 | — | S14 | 0.17/35 | 0.10 | 0.79 | G | G | P | P | Mg is below lower limit |
| | 15 | F1 | S15 | 0.25/45 | 0.45 | 1.24 | P | P | P | G | Fe/Mn > 0.4 |

As shown in Table 2, in Examples 1-6, the surface materials S1-S6 which satisfy the requirements according to the present invention showed excellent results, with the evaluations of "G" for all of the cathode reactivity, the corrosion resistance including corrosion resistance in immersion test (cooling-water side assumption test) and corrosion resistance in CASS test (air side assumption test) or the like, and the tensile strength.

On the other hand, in Comparative Examples 7-15, the surface materials S7-S15 which do not satisfy the requirements according to the present invention showed poor results, with the evaluations of "P" for the corrosion resistance and the tensile strength.

To sum up, in Comparative Examples 8, 10, 12 and 13 where the amount of one of Fe, Mn, Si and Zn is not in the range according to the present invention (which range otherwise gives advantages in corrosion resistance), at least one of the cathode reactivity, the corrosion resistance in immersion test and the corrosion resistance in CASS test was evaluated as "P". In addition, in Comparative Example 15 in which the specimen with the area ratio exceeding the upper limit (1%), all of the results regarding the corrosion resistance were evaluated as "P", even though the composition of the aluminum alloy plate satisfies the requirements according to the present invention.

From these results, it was found that the adjustment of not only the aluminum alloy plate composition but also the area ratio is important for obtaining the aluminum alloy plate having high strength and excellent corrosion resistance.

In Comparative Examples 7, 9, 11 and 14 where the amount of one of Fe, Mn, Si and Mg is not in the range (which range otherwise gives advantages in strength after brazing), all of the results regarding the tensile strength were evaluated as "P" (poor).

As described above, by adjusting the aluminum alloy plate composition and the area ratio so as to satisfy the requirements according to the present invention, the aluminum alloy plate having high strength and excellent corrosion resistance can be obtained. It should be noted that the presence of Mg especially enhances strength after brazing, as is demonstrated in the surface material S6. However, when the amount of Mg exceeds the upper limit according to the present invention, pressure bonding property and productivity were reduced.

The invention claimed is:

1. An aluminum alloy plate having a core material and a surface material clad on at least one side of the core material, wherein the surface material comprises 0.030-0.30% by mass of Fe, 0.40-1.9% by mass of Mn, 0.83-1.4% by mass of Si, and 2.0-5.5% by mass of Zn, the rest comprises Al and inevitably included impurities, and an area ratio of an intermetallic compound containing Al and Mn to a whole surface of the surface material is 1% or less.

2. The aluminum alloy plate according to claim 1, when the surface material is clad only on one side of the core material, further comprising a brazing material of an Al—Si based alloy clad on the other side of the core material.

3. The aluminum alloy plate according to claim 2, wherein the surface material further comprises 0.30-3.0% by mass of Mg.

4. A heat exchanger formed of the aluminum alloy plate according to claim 3.

5. The aluminum alloy plate according to claim 2, wherein the brazing material of an Al—Si based alloy contains 7-12% by mass of Si.

6. The aluminum alloy plate according to claim 1, wherein the surface material further comprises 0.30-3.0% by mass of Mg.

7. A heat exchanger formed of the aluminum alloy plate according to claim 6.

8. The aluminum alloy plate according to claim 1, wherein the inevitably included impurities include 0.1% by mass of Cr, 0.2% by mass or less of Ti, 0.2% by mass or less of Zr, and 0.1% by mass or less of B.

9. The aluminum alloy plate according to claim 1, wherein the core material includes 0.5-1.2% by mass of Cu, 0.6-1.9% by mass of Mn and 0.5-1.4% by mass of Si, with the rest including Al and inevitably included impurities.

10. A method of making an aluminum alloy plate, the method comprising cladding a surface material on a core material; and producing the aluminum alloy plate of claim 1.

11. A surface material for an aluminum alloy plate having a core material, the surface material being clad on at least one side of the core material, wherein the surface material comprises 0.030-0.30% by mass of Fe, 0.40-1.9% by mass of Mn, 0.83-1.4% by mass of Si, and 2.0-5.5% by mass of Zn, the rest comprises Al and inevitably included impurities, and an area ratio of an intermetallic compound containing Al and Mn to a whole surface of the surface material is 1% or less.

12. The surface material for an aluminum alloy plate according to claim 11, further comprising 0.30-3.0% by mass of Mg.

13. The surface material for an aluminum alloy plate according to claim 12, wherein when the surface material is clad only on one side of the core material, the aluminum alloy plate further comprises a brazing material of an Al—Si based alloy clad on the other side of the core material.

14. The surface material for an aluminum alloy plate according to claim 11, wherein when the surface material is clad only on one side of the core material, the aluminum alloy plate further comprises a brazing material of an Al—Si based alloy clad on the other side of the core material.

* * * * *